United States Patent [19]

Bauer et al.

[11] 4,014,084

[45] Mar. 29, 1977

[54] TEXTURIZING OF FILAMENTS

[75] Inventors: Wolfgang Bauer, Heidelberg; Wolfgang Martin, Ludwigshafen; Erwin Lehrer, Bad Duerkheim, all of Germany

[73] Assignee: BASF Farben & Fasern Aktiengesellschaft, Hamburg, Germany

[22] Filed: Mar. 15, 1976

[21] Appl. No.: 667,090

[30] Foreign Application Priority Data

Mar. 21, 1975 Germany ..... 2512457

[52] U.S. Cl. ..... 28/72.11; 28/72.12; 28/72.14

[51] Int. Cl.[2] ..... D02G 1/20; D02G 1/16; D02G 1/12

[58] Field of Search ..... 28/1.4, 1.3, 1.6, 72.4, 28/72.12, 72.14

[56] References Cited

UNITED STATES PATENTS

| | | | |
|---|---|---|---|
| 3,714,686 | 2/1973 | Schmid et al. | 28/1.4 |
| 3,849,844 | 11/1974 | Bauch et al. | 28/1.3 |
| 3,885,278 | 5/1975 | Whitaker | 28/1.6 X |
| 3,908,248 | 9/1975 | Schmid et al. | 28/1.4 |
| 3,956,807 | 5/1976 | Holland | 28/1.4 |
| 3,965,547 | 6/1976 | Ferrier et al. | 28/1.3 |

*Primary Examiner*—Louis K. Rimrodt
*Attorney, Agent, or Firm*—Johnston, Keil, Thompson & Shurtleff

[57] ABSTRACT

Filaments or filament bundles, which are conveyed by a heated gas, are crimped by treating them in a preheat chamber and crimping them in an elongate chamber from which the heated gas medium issues through longitudinal slits. A stream of cold gas is made to impinge on the outside of the lower one-third of the elongate chamber without allowing significant amounts of this cold gas to enter the said chamber. The resulting filaments or filament bundles have very good dyeing characteristics.

6 Claims, 2 Drawing Figures

A-B

TEXTURIZING OF FILAMENTS

Figure 1:
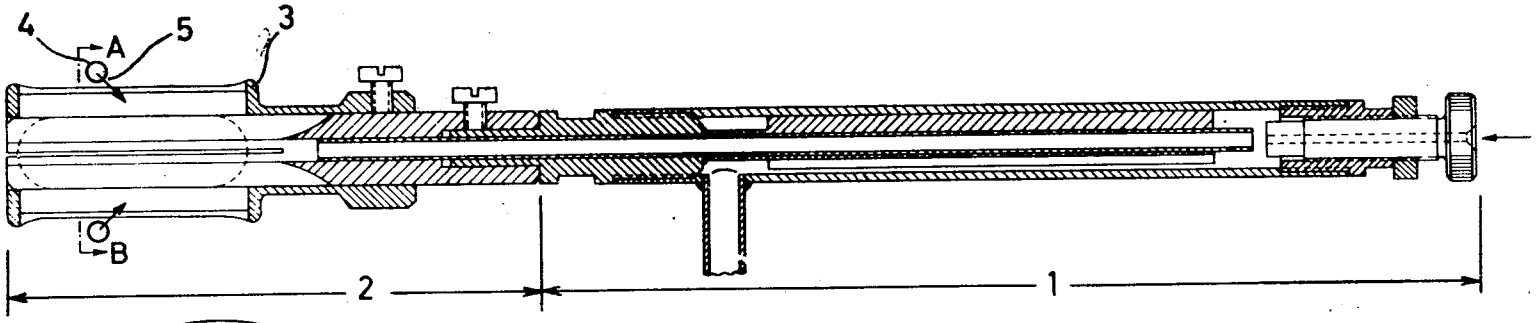

Numerous processes which permit crimping of the generally continuous and smooth filaments of synthetic organic linear high molecular weight materials have been disclosed. For example, crimping may be achieved by the use of stuffer boxes, false twisting, knife edges or by intermingling processes using fluid media.

According to the process disclosed in GDR Patent 17,786, the filament to be crimped is fed, by means of a stream of gas, into a stuffer box having a gas-permeable wall, is compressed and crimped therein, is cooled by means of a stream of gas blown into the chamber and leaves the chamber at a rate such that the crimp imparted to the filament persists. In this process, the gas streams used for heating and for cooling are kept apart by a partition. Both gas streams are brought into direct contact with the material to be treated.

With regard to the gas velocities to be used, the only indication given in the definition is that it should be sufficiently high for the crimp imparted to the filament to persist. The said reference suggests that the treatment chamber is first filled to a certain degree, and only then is the take-off of the crimped filaments or filament bundles started. It will readily be appreciated that the feed and take-off must be balanced, taking a certain amount of shrinkage into account, in order that the stuffer box should not run empty or become overfilled. In fact, if it were to run empty, the filament would be drawn off uncrimped, whilst if it were overfilled, the filament transport would cease.

U.S. Pat. No. 3,802,038 discloses a process for crimping filaments, wherein the filaments are forced, by a stream of heated gas, into a chamber which the heated gas leaves radially, and in which a stream of cold gas is blown into the chamber itself in counter-current to the take-off direction of the filaments, and also leaves the chamber in a radial direction. In this process, the filament is compressed in the chamber and passes, in this state, through the chamber, into the outlet tube, in which the cold gas travelling in countercurrent cools the filament. The crimped filament is then drawn off through an outlet nozzle.

In this process, again, the filament feed and filament take-off must be accurately balanced by means of a speed controller. In principle the same difficulties as before arise. A further disadvantage of this embodiment is that the filament is taken off during the cooling step. At relatively high speeds this induces stresses in the filament, by means of which the crimp is again destroyed. It has been found that at speeds above 800 m/minute these conditions can no longer be balanced as would be necessary to produce a uniformly crimped filament. It is an object of the present invention to provide a process for crimping filaments, whereby a crimped yarn of more uniform properties than that produced by conventional processes is obtained. Another object of the present invention is a process for the manufacture of uniformly crimped filament, in which little expenditure is required to achieve uniform properties. These and other objects of the invention will be apparent from the following detailed specification.

We have found that this object is achieved and that the crimping of filaments by treating the filaments to be crimped, conveyed by a heated gas, in a first treatment chamber, and by then crimping them in an elongate second treatment chamber, from which the heated gas medium emerges laterally through longitudinal slits, can be carried out at high speeds, and that filaments with uniform crimp and uniform dyeing properties are obtained, if a stream of relatively cold gas is caused to impinge on the outside of a lower portion of the elongate second treatment chamber without allowing significant amounts of this relatively cold gas to enter the said chamber.

As used in the present specification, the term "filaments" is to be understood as meaning continuous structures such as individual filaments or filament bundles, ribbons, flat filaments or fibers produced by fibrillation from films or strips of film. The denier of the individual filaments may be, eg., from 1 to 32 dtex. Preferably, individual filaments of from 10 to 30 dtex are used. The number of individual filaments in a filament bundle may be from 2 to several hundred, eg. up to 800. Filament bundles which contain from 60 to 150 individual filaments are preferred. The filaments in the filament bundles or yarns may have been drawn, or partially drawn, when fed to the crimping treatment. It is possible to use filaments of either round or profiled, e.g. trilobate, cross-section.

Suitable synthetic linear or substantially linear filament-forming organic high molecular weight materials which may be used for the manufacture of the filaments are, in particular, conventional linear synthetic high molecular weight polyamides with recurring amide groups in the backbone, linear synthetic high molecular weight polyesters with recurring ester groups in the backbone, filament-forming olefin polymers, filament-forming polyacrylonitrile, and filament-forming acrylonitrile copolymers which predominantly contain acrylonitrile units, as well as cellulose derivatives and cellulose esters. Examples of suitable high molecular weight compounds are nylon 6, nylon 6,6, polyethylene terephthalate, linear polyethylene and isotactic polypropylene.

Conventional fluid media may be used for conveying the filaments and for the crimping process, e.g. nitrogn, carbon dioxide, steam and — especially because of economic considerations — air. The requisite temperatures of the gas medium may vary within wide limits, but a range of from 80° to 550° C has proved suitable. The most advantageous conditions depend on the melt temperature or plasticizing temperature of the filament-forming materials, on the length of time for which the gas is able to act on the filaments, on any preheating treatments and, finally, on the denier of the filaments. Naturally, temperatures which could cause the filaments to melt under the conditions used must not be employed, though the temperatures themselves can be above the melting point or decomposition point of the filament-forming materials employed, provided that the filaments are passed through the treatment zone at a suitably high speed, i.e., with a short residence time. The higher is the texturizing speed, the greater is the amount by which the temperature of the texturizing medium may be above the melting point or decomposition point of the filament-forming material used.

A suitable apparatus for the process is described, e.g., in German Printed Application 2,006,022. This apparatus consists of a preheat chamber heated by the hot gas medium which travels in countercurrent, followed by a slit nozzle. According to the present invention, the cold gas is caused to impinge on the lower one-third of the elongate treatment chamber, i.e., in the case of the above apparatus, to impinge on the said slit nozzle.

Figure 2:
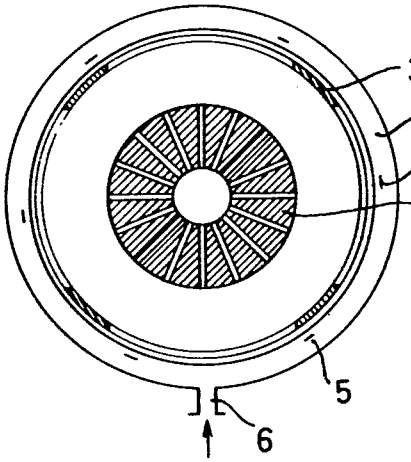

FIGS. 1 and 2 show a simple apparatus suitable for the process. This consists of the apparatus described in German Printed Application 2,006,022 with a first treatment chamber 1 followed by the second treatment chamber (slit nozzle) 2, which in this case is surrounded by an "orifice protector" 3. The orifice protector 3 at the same time acts as a carrier for the annular nozzle 4 from which the cold air, issuing through a number of orifices 5, impinges at the desired angle on the lower one-third of the slit nozzle. The annular nozzle 4 is fed with the blowing air through a nipple 6. FIG. 2 shows a cross-section at A-B through FIG. 1. Of course, instead of the annular nozzle a circle of separate nozzles can be employed. Equally, the annular nozzle need not be fixed to the orifice protector and can be fixed in a different way instead. Finally, it is advantageous to use slit nozzles with a continuous (closed) ring at the outlet end, since this makes it possible to dispense with the orifice protector whilst still ensuring the dimensional stability of the slit nozzle.

The gas used for the "cold blow", which can be the same gas as that used for conveying and crimping, and which as a rule will preferably be air, is in general at from 0° to 40° C and is fed in at from 0.5 to 8 bars, preferably from 1 to 4 bars, gauge pressure.

The temperature of the second treatment chamber (the slit nozzle) 2 is advantageously from 60° to 160° C. Of course, this temperature is only achieved if appropriate gas velocities are maintained (i.e., appropriate amounts of gas are passed through). As a result of the cold blow against the lower end, e.g. one-third, or one-fourth, up to half the length of the nozzle, a temperature gradient is set up in the treatment chamber 2, the colder part being toward the end, viewed in the direction of travel; it is advantageous to set up a temperature gradient of from 50° to 100° C, especially from 70° to 90° C, over the length of the slit. This effect can be boosted, e.g., by interposing materials of low heat conductivity between the first (upper) and second (lower) treatment chambers, e.g., materials with heat conductivities of from 0.05 to 13 kcal/hr.m. degree. Examples of suitable materials are graphite-filled phenol-formaldehyde resins with heat conductivities of from 2.4 to 3.0 kcal/hr.m. degree, available under the tradename Bascodur, or epoxy resins with heat conductivities of from 0.126 to 0.45 kcal/hr.m. degree, such as are known under the tradename Lekutherm. However, even nickel-alloy steels with heat conductivities of up to 9.5 kcal/hr.m. degree — which in general contain not more than 35% of nickel — still produce a significant effect.

It follows from the temperature of the gas used for the cold blow that a certain flow velocity must be used to achieve an effect which exceeds that of natural cooling due to the surrounding air. This velocity should therefore advantageously not be less than 30 m/sec., but can be greater than this, up to the speed of sound. Advantageously, the velocity at the nozzle is from 60 to 300 m/sec. Since uniform cooling from all sides is desirable, it is advantageous to supply the cold air through several nozzles, for example from two to eight, which are arranged in a ring around the elongate treatment chamber (slit nozzle). The amount of cold gas required is usually from 0.5 to 5 $m^3$ (S.T.P.)/hr, preferably from 1 to 4 $m^3$ (S.T.P.)/hr, depending on the type and diameter of the nozzle.

The cold gas can be blown against the nozzle in a plane at right angles to the direction of travel of the yarn, or at an angle to the latter, which angle is from 30° to 90°, if one arm of the angle points in the direction of travel of the yarn and the other rests against the surface of a cone of which the apex points against the direction of yarn travel, whilst its axis lies in the direction of yarn travel; this angle is referred to as the blow angle.

The flow velocity should be such that only insignificant amounts of the cold gas enter the elongate treatment chamber through the slits in the latter.

It is known that the amount of a fluid medium which passes through a passage depends on the pressure differential and hence on the flow velocity and on the passage cross-section. The pressure differential can be established by dynamic pressure measurements in both the streams in question and can then be mutually balanced. In equilibrium, a point with a dynamic pressure of 0 will be measured, and if one direction of flow predominates, a positive or negative dynamic pressure will be measured, depending on the direction in which the sensor is open. For example, the dynamic pressure can be measured with a dynamic pressure sensor at a distance of 1 mm from the slits of the treatment chamber, at an angle of 30° C according to the definition of the blow angle, 0 to 20 mm viewed in the direction of yarn travel and calculated from the passage through the slits into the environment. Pressures measured in this way, in the range from 300 mm water column to −25 mm water column (the negative value relating to suction through the slit nozzle) reliably ensure that only insignificant amounts of the cold gas enter through the slits.

The temperatures to be used for crimping differ for the various filament-forming polymers and depend also on the denier and the number of individual filaments. For example, the plasticizing temperature range is from 80° to 90° C for linear polyethylene, from 80° to 120° C for polypropylene, from 165° to 190° C for nylon 6, from 120° to 240° C for nylon 6,6 and from 190° to 230° C for polyethylene terephthalate.

If a filament bundle is introduced into the crimping apparatus, e.g. at 2,000 m/minute, the temperature of the gas medium can be from 150° to 250° C above the temperature of the plasticizing range of the high molecular weight material used.

For a 4,200 dtex filament bundle of nylon 6, comprising 67 individual filaments, it is, e.g., advisable to use, after the drawing zone, a feed velocity of 2,000 m/minute and a temperature of from 340° to 440° C for the gas medium, whilst the filament, after drawing, is advantageously passed over a heated godet at a surface temperature of from 140° to 180° C. The upper temperature limit of the gas medium used is about 550° C and depends on the heat resistance of the materials from which the crimping apparatus is constructed. The optimum temperature for filaments made from other types of polymers are established by experiment. In general, from 4 to 16 $m^3$ (S.T.P.)/hr of fluid medium, preferably from 6 to 10 $m^3$ (S.T.P.)/hr, is used to convey the filament bundles.

To achieve a particularly effective cold blow it can be advantageous to use a treatment chamber (slit nozzle) profiled in a particular way by so constructing the lands as to improve heat conduction, e.g. by attaching cooling fins or cooling ribs or using triangular lands made not from solid material but from angled profiles with wall thicknesses of from 0.2 to 1 mm, the side facing away from the yarn being kept open so that the stream of air used for the cold blow is effectively guided and the cooling surface area is increased.

The advantage of the new process is that texturizing speeds of 2,000 m/minute or even more, e.g. 2,500 m/minute, are achieved and the yarn has a very good and uniform crimp and exceptionally uniform dyeing properties. The great uniformity of the yarn is attributable to the fact that no mechanical elements are needed to receive the yarn or draw off the yarn, so that the yarn is not subjected to any mechanical stress by conveying elements or by the stream of air which is employed.

The crimp rigidity is used as a measure of the quality of the crimp. To determine the crimp rigidity, a hank of yarn is boiled for 5 minutes in water, left, free from tension, at room temperature for 20 minutes, then subjected to a load of 0.5 p/dtex (at which load the length L is determined) and thereafter subjected to a load of 0.001 p/dtex to determine the new length l. From these lengths, the crimp rigidity is calculated by using the equation:

$$\frac{L-l}{L} = 100\%$$

EXAMPLE 1

An undrawn 67-filament nylon 6 yarn of total denier 4,200 dtex is taken from a supply package and passed via drawing means to a texturizing apparatus comprising treatment chambers. The temperature of the input godet is 150° C. The filament which has been preheated and drawn is introduced into the texturizing apparatus at the rate of 2,000 m/minute. Air at 380° C and 7 bars absolute is fed into the texturizing apparatus. The amount of air is 7.8 $m^3$ (S.T.P.)/hr. The total length of the treatment chamber 2 is 56 mm and the cold air is blown from nozzles arranged in a ring, at a distance of 25 mm from the yarn outlet, against the treatment chamber at an angle of 30°. 3.5 $m^3$ (S.T.P.)/hr of air at 22° C are used for this purpose. The air velocity at the individual nozzles is 200 m/sec.

The yarn thereby obtained has the following properties:

| | |
|---|---|
| Denier: | 1,420 dtex |
| Elongation: | 45% |
| Tenacity: | 2.56 p/dtex |
| Shrinkage: | 1.6% |

-continued

| | |
|---|---|
| Crimp rigidity: | 10.6% |

The crimp is uniform, spacious and finely curved, so that high bulk results.

In contrast, if the blow air is not used, the crimp rigidity achieved at 2,000 m/minute input speed is only 4.9%. If it is desired to obtain a yarn having a crimp of the same order of magnitude as before, without employing the measure described above, the input speed must be lowered to 1,200 m/minute or less.

EXAMPLE 2

An undrawn 67-filament nylon 6 yarn with a total denier of 4,200 dtex is fed to a texturizing apparatus as described in Example 1. The temperature of the input godet is 133° C. Air at a temperature of 380° C and a pressure of 5.8 bars absolute is fed to the texturizing apparatus. The yarn is fed to the treatment chamber at a speed of 1,200 m/minute. If the pressure is measured as defined above, using a dynamic pressure sensor, it is found to be 54 mm water column if the process is carried out without cold blow, and 20 mm water column if it is carried out with cold blow. 3.5 $m^3$ (S.T.P.)/hr of air at 22° C are used for the cold blow. The air velocity at the individual nozzles is 200 m/sec.

We claim:

1. A process for crimping filaments by treating these filaments, conveyed by a heated gas, in a first treatment chamber and crimping them in an elongate second treatment chamber, the temperature of which is kept at from 60° to 160° C, from which second treatment chamber the heated gas medium issues through longitudinal slits, wherein the stream of relatively cold gas is caused to impinge on the outside of a lower portion of the elongate second treatment chamber without allowing significant amounts of this relatively cold gas to enter the second treatment chamber.

2. A process as claimed in claim 1, wherein the relatively cold gas impinges on the final one-third of the elongate second treatment chamber.

3. A process as claimed in claim 1, wherein the amount of relatively cold gas applied is from 0.5 to 5 $m^3$ (S.T.P.)/hr.

4. A process as claimed in claim 1, wherein the flow velocity of the relatively cold gas at the nozzle is from 30 m/sec to the speed of sound.

5. A process as claimed in claim 1, wherein the relatively cold gas is blown against the elongate second treatment chamber at right angles or at a blow angle of from 30° to 90° C.

6. A process as claimed in claim 1, wherein the relatively cold gas has a temperature of 0° to 40° C.

* * * * *